United States Patent [19]

Klotz et al.

[11] Patent Number: 4,981,573

[45] Date of Patent: Jan. 1, 1991

[54] PROCESS FOR THE PRODUCTION OF ALKALI DICHROMATES AND CHROMIC ACID EMPLOYING AN ANODE OF VALVE METAL ACTIVATED BY ELECTRODEPOSITING NOBLE METALS FROM MELTS

[75] Inventors: Helmut Klotz, Bergisch Gladbach; Rainer Weber, Leverkusen; Hans-Dieter Block, Leverkusen; Norbert Lönhoff, Leverkusen, all of Fed. Rep. of Germany

[73] Assignee: Bayer Aktiengesellschaft, Leverkusen, Fed. Rep. of Germany

[21] Appl. No.: 392,873

[22] Filed: Aug. 11, 1989

[30] Foreign Application Priority Data

Aug. 27, 1988 [DE] Fed. Rep. of Germany ..... 3829119

[51] Int. Cl.[5] ..... C25B 1/22; C25B 1/00

[52] U.S. Cl. ..... 204/59 R; 204/89; 204/97; 204/290 F

[58] Field of Search ..... 204/292, 290 F, 89, 204/39, 97, 59 R

[56] References Cited

U.S. PATENT DOCUMENTS

| | | | |
|---|---|---|---|
| 3,305,463 | 2/1967 | Carlin | 204/89 |
| 3,309,292 | 3/1967 | Andrews et al. | 204/39 |
| 3,454,478 | 8/1969 | Carlin | 204/130 |

FOREIGN PATENT DOCUMENTS

| | | | |
|---|---|---|---|
| 739447 | 7/1966 | Canada | 204/97 |
| 3020260 | 12/1980 | Fed. Rep. of Germany . | |
| 2051869 | 1/1981 | United Kingdom . | |

OTHER PUBLICATIONS

Harding, "The Electrodeposition of Platinum, Iridium and Platinum–Iridium Alloy Coatings from Molten Salt Electrolytes", Plating and Surface Finishing, pp. 30–35, Feb. 1978.

Metall, vol. 34, No. 11, Nov. 1980, pp. 1016 and 1018.

Galvanotechnik, vol. 70, 1979, pp. 420 to 428.

Galvanotechnik, vol. 70, No. 5, 1979, pp. 420–428; J. Wurm: "Elektolytische Beschichtungen aus der Salzschmelze", *p. 425, Absatz 4.3*.

*Primary Examiner*—John F. Niebling

*Assistant Examiner*—Kathryn Gorgos

*Attorney, Agent, or Firm*—Sprung Horn Kramer & Woods

[57] ABSTRACT

A process for the production of alkali dichromates and chromic acid by electrolysis of alkali monochromate or alkali dichromate solutions wherein the anodes used in the electrolysis are dimensionally stable anodes of valve metals activated by electrodeposition of noble metals and/or noble compounds from melts containing noble metal salts.

2 Claims, No Drawings

PROCESS FOR THE PRODUCTION OF ALKALI DICHROMATES AND CHROMIC ACID EMPLOYING AN ANODE OF VALVE METAL ACTIVATED BY ELECTRODEPOSITING NOBLE METALS FROM MELTS

BACKGROUND OF THE INVENTION

1. Field of the Invention

This invention relates to a process for the production of alkali dichromates and chromic acid by electrolysis of alkali monochromate or alkali dichromate solutions.

2. Description of Related Art

According to U.S. Pat. No. 3,305,463 and CA-A-No. 739,447, the electrolytic production of dichromates and chromic acid takes place in electrolysis cells of which the electrode compartments are separated by cation exchanger membranes. In the production of alkali dichromates, alkali monochromate solutions or suspensions are introduced into the anode compartment of the cell and are converted into an alkali dichromate solution by the selective transfer of alkali ions through the membrane into the cathode compartment. For the production of chromic acid, alkali dichromate or alkali monochromate solutions or a mixture of alkali dichromate and alkali monochromate solutions are introduced into the anode compartment and converted into solutions containing chromic acid. Sodium monochromate and/or sodium dichromate are generally used for these processes. In both processes, an alkaline solution containing alkali ions is obtained in the cathode compartment, consisting for example of an aqueous sodium hydroxide solution or, as described in CA-A-No. 739,447, of an aqueous solution containing sodium carbonate.

To produce alkali dichromate or chromic acid crystals, the solutions formed in the anode compartments of the cells are concentrated; the crystallization of sodium dichromate can be carried out, for example, at 80° C. and the crystallization of chromic acid at 60° to 100° C. The products crystallized out are separated off, optionally washed and dried.

According to DE-A No. 3 020 260, anodes of lead and lead alloys are suitable as anode materials. These anode materials have the disadvantage that, as a result of corrosion, lead ions can enter the solution in the anode compartment, leading to contamination of the alkali dichromates and chromic acid produced. According to DE-A No. 3 020 260, other suitable anodes are so-called dimensionally stable anodes which consist of a valve metal, such as titanium or tantalum, with an electrocatalytically active layer of noble metal or a metal noble oxide. However, anodes of this type have only a limited useful life of less than 100 days, particularly at electrolysis temperatures above 60° C. and anodic current densities of 2–5 kA/m$^2$. Useful lives as short as these are inadequate for the economic production of alkali dichromate and chromic acid by electrolysis.

SUMMARY OF THE INVENTION

The object of the present invention is to provide economic processes for the production of alkali dichromates and chromic acid. It has now been found that anodes of valve metals, which have been activated by electrodeposition of noble metals and/or noble metal compounds from melts containing noble metal salts, are eminently suitable for the production of alkali dichromates and chromic acid.

Accordingly, the present invention relates to a process for the production of alkali dichromates and chromic acid by electrolysis of alkali monochromate or alkali dichromate solutions which is characterized in that dimensionally stable anodes of valve metals activated by electrodeposition of noble metals and/or noble compounds from melts containing noble metal salts are used.

DESCRIPTION OF THE PREFERRED EMBODIMENTS

Particularly preferred anodes are those coated with platinum, iridium, with platinum and iridium compounds or alloys of the elements mentioned produced by electrolysis of salt melts of the corresponding elements. The alloys may also contain platinum and iridium compounds, particularly oxides.

Suitable anodes having the properties mentioned are described, for example, in the journal METALL, Vol. 34, Number 11, Nov. 1980, pages 1016 to 1018 and in the journal Galvanotechnik, Vol. 70, 1979, pages 420 to 428. Anodes of this type are distinguished by a useful life of far more than 100 days without any significant change in the initial cell voltage, particularly at electrolysis temperatures of 70° to 90° C. and at current densities of 2 to 5 KA/m$^2$. The use of these anodes enables the production of alkali dichromate and chromic acid to be carried out particularly economically. For example, there is no longer any need for the relatively frequent changing of anodes with the associated production losses. In addition, the specific energy consumption of the electrolysis process is uniformly favorable by virtue of the very high stability of these anodes at temperatures above 70° C. The process according to the invention is illustrated by the following Examples.

The electrolysis cells used in the Examples consisted of anode compartments of pure titanium and cathode compartments of stainless steel. The membranes used were cation exchanger membranes or the Nafion ®324 type made by Du Pont. The cathodes consisted of stainless steel and the anodes of titanium with the electrocatalytically active coatings described in the individual Examples. In every case, the interval between the electrodes and the membrane was 1.5 mm. Sodium dichromate solutions of varying concentration were introduced into the anode compartments. Water was introduced into the cathode compartments at such a rate that 20% sodium hydroxide left the cells. In every case, the electrolysis temperature was 80° C. and the current density 3 kA/m$^2$ projected frontal area of the anodes and cathodes.

EXAMPLE 1

(Comparison)

The titanium anode used in this Example with a platinum layer produced by wet electrodeposition was produced as follows: after removal of the oxide coating and etching with oxalic acid, a titanium expanded-metal anode with a projected frontal area facing the membrane of 10 cm·3.6 cm was electrolytically coated with 1.065 g platinum, corresponding to a layer thickness of 2.59 μm based on the projected area of the anode. The electrolyte used consisted of 5 g/l $PtCl_4$, 45 g/l $(NH_4)_2HPO_4$ and 240 g/l $Na_2HPO_4 \cdot 12\ H_2O$. The electrolytic deposition was carried out under the following parameters:

Cathodic current density: 1.5 A/dm$^2$
Temperature: 80° C.
Deposition time: 2 hours
pH value: 7.8
Anode: platinum gauze
Electrode interval: 70 to 75 mm Using this anode, a sodium dichromate solution containing 900 g/l $Na_2Cr_2O_7 \cdot 2\ H_2O$ was electrolytically converted into a solution containing chromic acid in the described electrolysis cell. The rate at which the sodium dichromate solution was introduced was selected so that a molar ratio of sodium ions to chromium(VI) of 0.32 was established in the anolyte leaving the cell.

During the test, the cell voltage rose from an initial value of 5 V to 8.5 V in 5 days. This increase was attributable to the almost complete destruction of the electrocalatyically active platinum layer of the titanium anode.

EXAMPLE 2

(Comparison)

A titanium expanded metal anode with a platinum-/iridium layer produced as follows by the so-called stoving process was used in this Example. After removal of the oxide coating and etching with oxalic acid, a titanium expanded-metal anode having a projected frontal area of 10 cm·3.6 cm was wetted with an HCl-containing solution of platinum tetrachloride and iridium tetrachloride in 1-butanol using a hair brush. The ratio by weight of platinum to iridium of this solution was 3.6:1. The wetted anode was dried for 15 minutes at 250° C. and then heated in an oven for 20 to 30 minutes at 450° C. This operation was repeated 6 times, the heat treatment only being carried out after every second step on completion of wetting and drying. The final anode had a layer containing approximately 18 mg platinum and 5 mg iridium.

By means of this anode, a sodium dichromate solution containing 900 g/l $Na_2Cr_2O_7 \cdot 2\ H_2O$ was electrolytically converted into a solution containing chromic acid. The rate at which the sodium dichromate solution was introduced was selected so that molar ratios of sodium ions to chromium(VI) of from 0.30 to 0.73 were established in the anolyte leaving the cell. During the test, the cell voltage rose from 4.7V to 7.8V in 18 days. This increase was attributable as in Example 1 to the almost complete destruction of the electrocatalytically active layer.

EXAMPLE 3

(Invention)

A titanium expanded-metal electrode having a projected frontal area of 11.4 cm· 6.7 cm with a platinum layer produced by melt electrodeposition, as described in the journal METALL, Vol. 34, No. 11, Nov. 1980, pages 1016 to 1018, was used in this Example of the invention. The platinum layer thickness of the anode was 2.5 μm. Using this anode, a solution containing 800 g/l $Na_2Cr_2O_7 \cdot 2\ H_2O$ was converted into a solution containing chromic acid. The rate at which the sodium dichromate solution was introduced was selected so that a molar ratio of sodium ions to chromium(VI) of 0.61 was established in the anolyte leaving the cell.

During the test period of 150 days, there was only a negligible increase in the cell voltage from the initial value of 4.9V to 5.0V, showing that the electrocatalytically active layer had remained substantially intact.

What is claimed is:

1. In a process for the production of a alkali dichromates and chromic acid by electrolysis of alkali monochromate or alkali dichromate solutions wherein the improvement comprises carrying out the electrolysis using dimensionally stable anodes of valve metals which are activated by electrodeposition of noble metals noble metal compounds or mixtures thereof from melts containing noble metal salts.

2. A process according to claim 1, wherein the anodes are activated with platinum, iridium, with platinum and iridium compounds or with alloys of said elements and compounds.

* * * * *